US005118035A

United States Patent [19]

Brochu et al.

[11] Patent Number: 5,118,035

[45] Date of Patent: Jun. 2, 1992

[54] CARTON ASSEMBLY FOR FLOUR OR SUGAR

[75] Inventors: Simon Brochu, Montreal; Patrick K. O'Donoughue, Longueuil, both of Canada

[73] Assignee: Ogilvie Mills Ltd., Canada

[21] Appl. No.: 713,148

[22] Filed: Jun. 11, 1991

[30] Foreign Application Priority Data

Jun. 19, 1990 [CA] Canada ..... 2,019,467

[51] Int. Cl.[5] ..... B65D 43/04

[52] U.S. Cl. ..... 229/125.17; 220/307; 220/352

[58] Field of Search ..... 229/125.09, 125.17, 229/125.32, 190; 220/306, 307, 352

[56] References Cited

U.S. PATENT DOCUMENTS

| | | | |
|---|---|---|---|
| 809,812 | 1/1906 | Kimsey | 229/5.6 |
| 1,161,236 | 11/1915 | Marcuse | 220/352 |
| 1,403,572 | 1/1922 | Schneider | 220/352 |
| 2,737,205 | 3/1956 | Stringfield | 220/352 |
| 2,990,998 | 7/1961 | Barclay | 229/125.17 |
| 3,190,537 | 6/1965 | Meinecke et al. | 229/125.17 |
| 4,016,807 | 4/1977 | Schellenberg | 229/5.5 |
| 4,046,282 | 9/1977 | Ruch | 220/307 |
| 4,252,248 | 2/1981 | Obrist et al. | 220/306 |

FOREIGN PATENT DOCUMENTS

| | | | |
|---|---|---|---|
| 559942 | 7/1958 | Canada | 229/125.17 |
| 3904265 | 8/1990 | Fed. Rep. of Germany | 220/352 |
| 958258 | 5/1964 | United Kingdom | 220/352 |

*Primary Examiner*—Gary E. Elkins

*Attorney, Agent, or Firm*—Stevens, Davis, Miller & Mosher

[57] ABSTRACT

Packaging for flowable material such as flour or sugar is provided by a carton with a removable and replaceable lid. The lid is formed as a single molding of synthetic plastic material and comprises an imperforate rectangular base, a peripherally continuous wall extending upwardly from the periphery of the base, and at least one lip projecting inwardly from the wall adjacent to the top thereof and spaced above the base to enable fingers of a human hand to be inserted under the lip to enable the lid to be removed from the carton. The carton is formed from a one-piece cardboard blank to provide a rectangular body with a closed bottom and an open top into which the lid is inserted.

10 Claims, 3 Drawing Sheets

CARTON ASSEMBLY FOR FLOUR OR SUGAR

This invention relates to the packaging of flowable solid material such as flour or sugar.

Flowable solid material such as flour or sugar has for many years usually been packaged in paper packages which are difficult to open and are not reclosable. Although various improvements have been suggested in the past, none have found acceptance in the marketplace.

It is therefore an object of the invention to provide improved packaging for flowable solid material such as flour or sugar which is suitable for its purpose, cost effective, readily shippable, acceptable to the consumer and hence acceptable in the marketplace.

According to the invention, packaging for flowable material such as flour or sugar comprises a carton and a removable and replaceable lid. The lid is formed as a single molding of synthetic plastic material and comprises an imperforate rectangular base, a peripherally continuous wall extending upwardly from the periphery of the base, and at least one lip projecting inwardly from the wall adjacent to the top thereof and spaced above the base to enable fingers of a human hand to be inserted under the lip to enable the lid to be removed from the carton. The carton is formed from a one-piece cardboard blank to provide a rectangular body with a closed bottom and an open top onto which the lid is inserted.

The lip of the lid preferably extends for substantially the whole length of a side or end of the lid, and the lid may comprise two of such lips at opposite sides or ends of the lid. Advantageously, the lid comprises four of such lips at opposite sides and ends of the lid, each lip extending for substantially the whole length of the side or end concerned and being at least partially spaced from adjacent lips at the corners of the lid.

The lid wall may have an outwardly projecting ledge extending therearound adjacent to the top thereof and limiting the depth of insertion of the lid into the open top of the carton. The lid wall may also have at least one outwardly projecting rib extending therearound below the outwardly projecting ledge, the at least one rib projecting outwardly a distance substantially less than the ledge and frictionally engaging the inner wall of the open top of the carton to retain the lid in assembly therewith.

The rectangular carton body may be formed by securing opposed side edge portions of the blank together in overlapping relationship, with the carton body consequently having a wall portion of double thickness where the overlap occurs, a portion of each rib being recessed to accommodate the double thickness portion of the carton wall. Preferably, the double thickness portion of the carton wall is adjacent a corner of the carton body and the externally recessed portion of each rib is likewise adjacent a corner of the lid.

Figure 1:
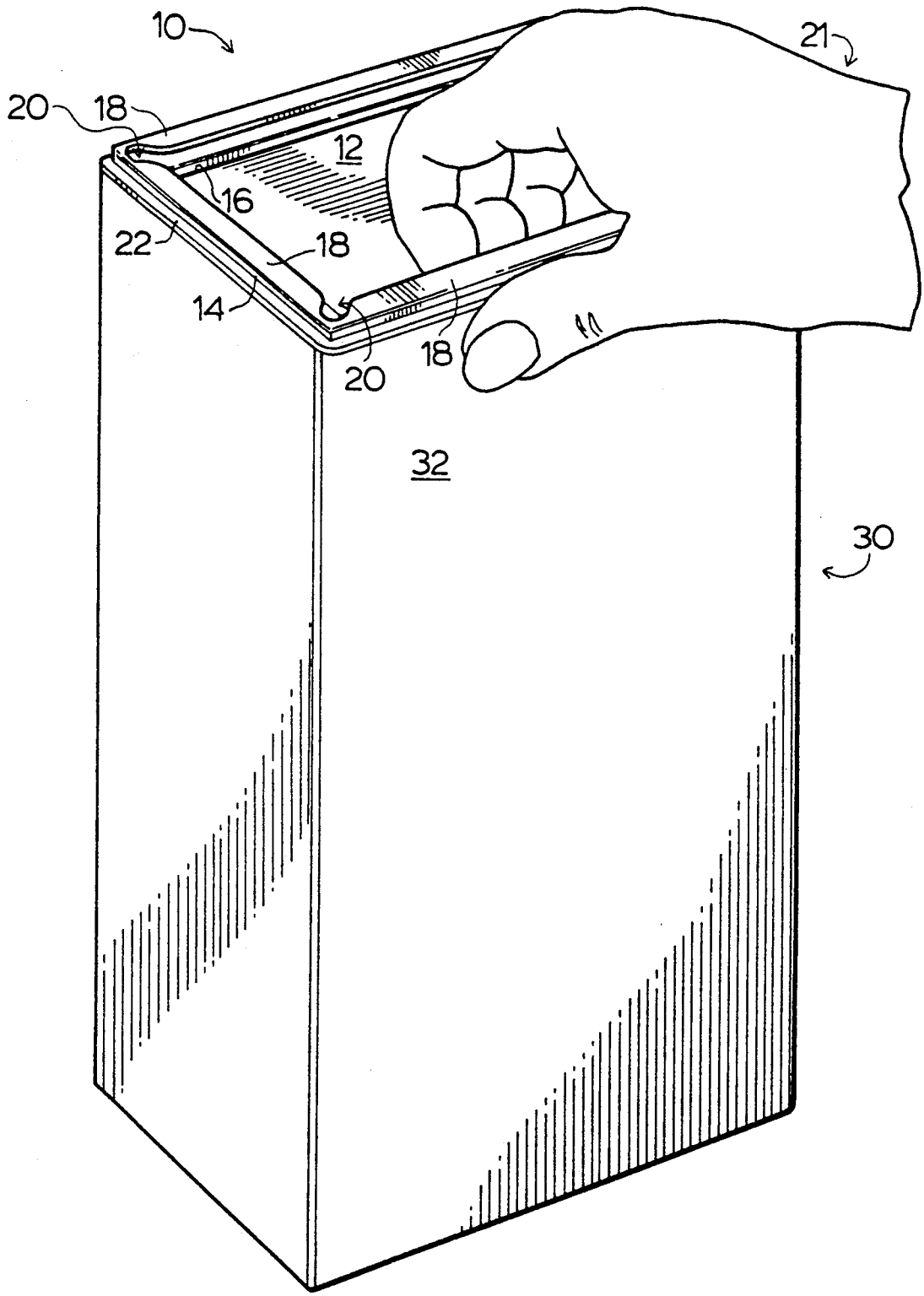
Figure 2:
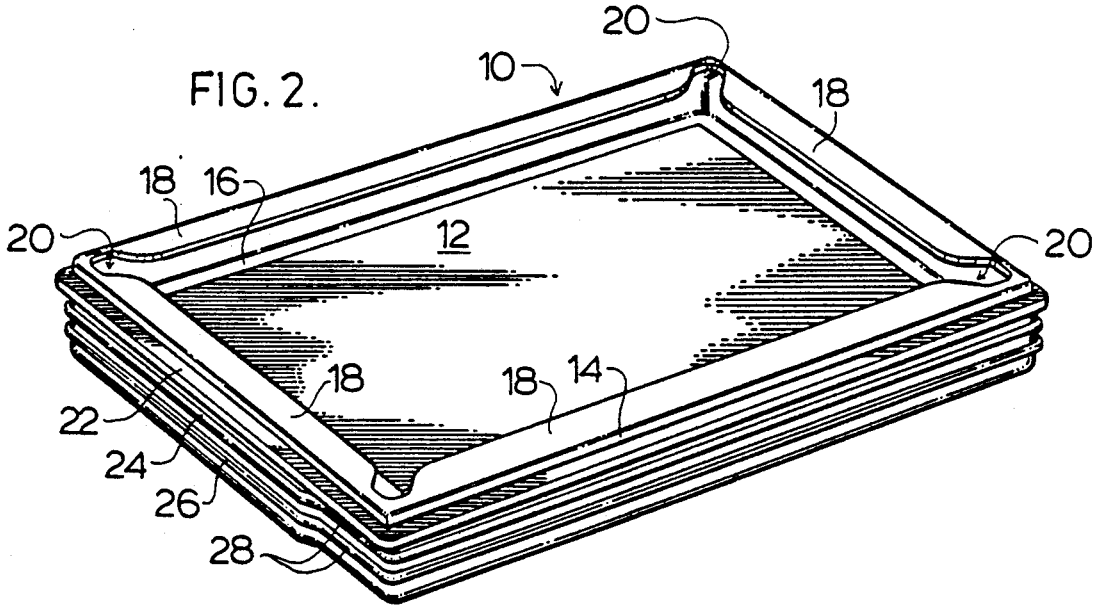
Figure 4:
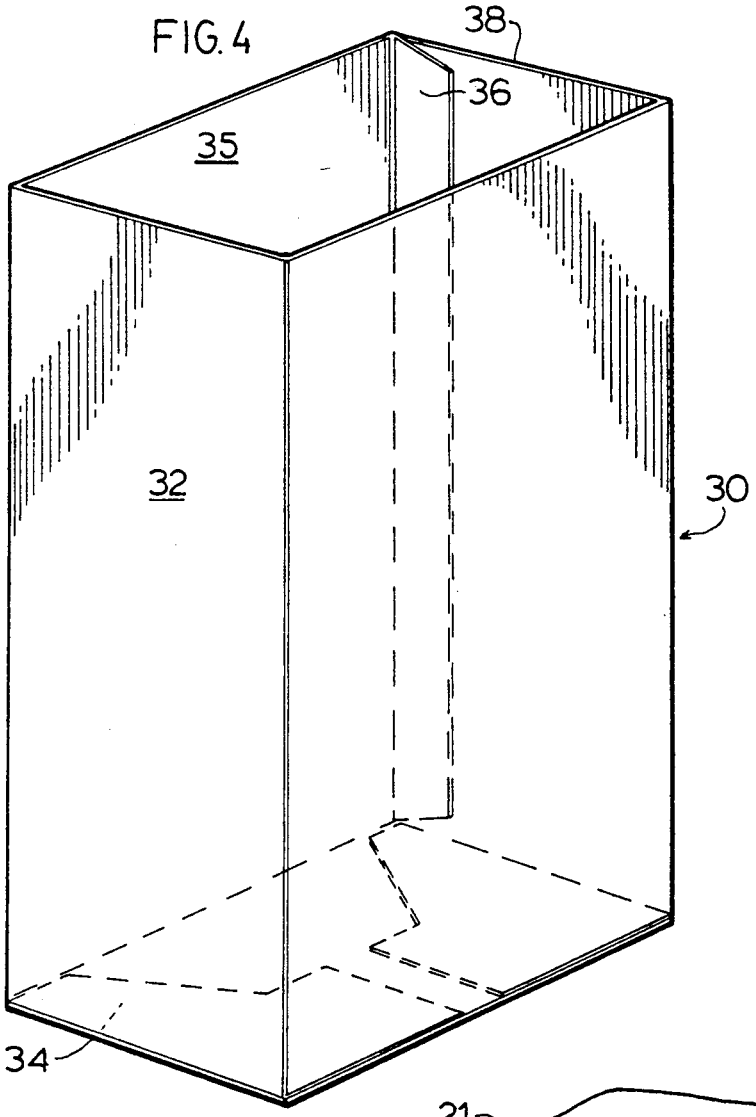
Figure 3:
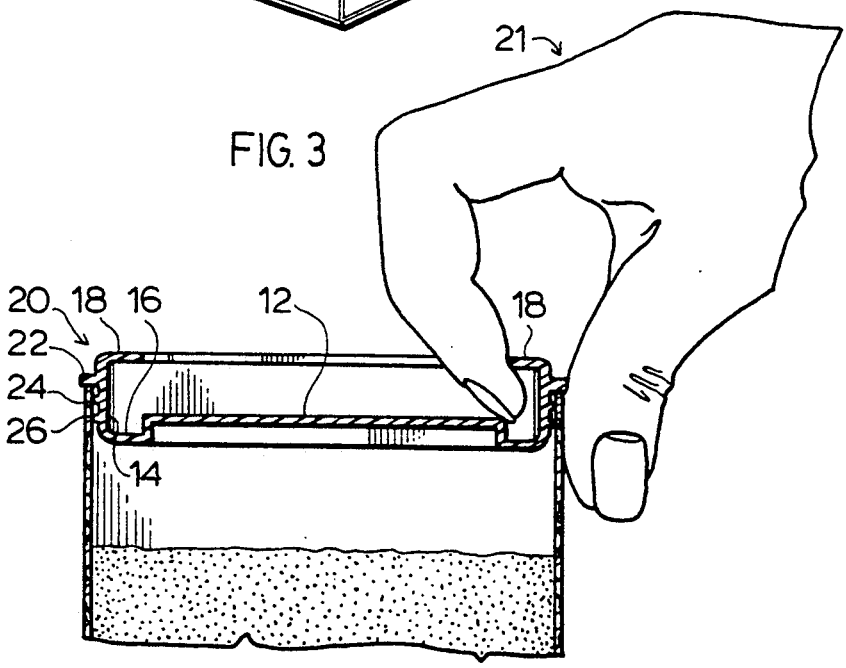

One embodiment of the invention will now be described, by way of example, with reference to the accompanying drawing of which:

FIG. 1 is a perspective view of a closed carton assembly showing how the fingers of a human hand can be positioned to remove the lid, FIG. 2 is a perspective view of the lid, FIG. 3 is a sectional view of the closed carton assembly, and FIG. 4 is a perspective view of the carton.

Referring to the drawings, the carton lid 10 is formed as a single molding of suitable plastic material, such as polyethylene, and comprises an imperforate rectangular base 12 with a peripherally continuous wall 14 extending upwardly from the periphery of the base 12. The major portion of the base 12 is flat and panel-like but immediately adjacent to the wall 14 the base 12 is shaped to provide a peripheral trough 16.

Four lips 18 project peripherally inwardly from adjacent the top of the peripheral wall 14 at opposite sides and ends of the lid 10, each lip 18 extending for substantially the whole length of the side or end concerned but being spaced by recesses 20 from adjacent lips 18 at the corners of the lid 10. Lips 18 are sufficiently spaced above the base 12 to enable finger tips of a human hand 21 to be inserted under a lip 18, the trough 16 facilitating such an operation.

The lid wall 14 has an outwardly projecting ledge 22 extending therearound adjacent the top, and also has a pair of vertically spaced outwardly projecting ribs 24, 26 extending therearound below the outwardly projecting ledge 22. Each rib 24, 26 projects outwardly a distance substantially less than the ledge 22. Portions 28 of the ribs 24, 26 are externally recessed adjacent diagonally opposite corners of the lid 10. FIG. 2 shows recessed rib portions 28 adjacent one corner. It will be understood that the ribs 24, 26 have similar recessed portions adjacent the diagonally opposite corner.

The carton 30 is formed from a one-piece cardboard blank to provide a rectangular body 32 with a closed bottom 34 and an open top 35. The rectangular body 32 is formed by adhesively securing opposed side edge portions 36, 38 together in overlapping relationship adjacent a corner of the carton body 32, with there consequently being a wall portion of double thickness where the overlap occurs. The closed bottom 34 may be formed in any convenient manner as will be readily apparent to a person skilled in the art.

In use, the lid 10 is assembled with the carton 30 by simply pressing the lid 10 into the open top 35 so that the lid ribs 24, 26 frictionally engage the interior of the carton body 32, and until the lid ledge 22 engages the upper edge of the carton body 32 to limit insertion of the lid thereinto. One pair of recessed rib portions 28 (regardless of the actual orientation of the lid 10 relative to the carton 30) will receive the double thickness wall portion formed by the overlapping edge portions 36, 38 of the carton 30.

Initially, the operation can be carried out by automated equipment which first forms the carton from the blank and fills the formed carton with flowable solid material such as flour or sugar. For shipping, an easily removable band (not shown) may be applied around the lid 10 and upper end of the carton 30, such a band also serving as a tamper-evident feature.

A purchaser can readily remove the band and then remove and replace the lid 10 as often as desired. The lid 10 is easily removable by insertion of finger tips under one of the lips 18 and pulling upwards.

The advantages of the invention for the packaging of flowable solid material such as flour or sugar will be readily apparent from the foregoing description of a preferred embodiment. Other embodiments of the invention will also be readily apparent to a person skilled in the art, the scope of the invention being defined in the appended claims.

We claim:

1. A removable and replaceable carton lid insertable into the open top of a carton, said lid being formed as a single molding of synthetic plastic material and comprising an imperforate rectangular base, a peripherally continuous wall extending upwardly from the periphery of the base, and at least one lip projecting inwardly from the wall adjacent to the top thereof and spaced above the base to enable fingers of a human hand to be inserted under the lip to enable the lid to be removed from the carton, said lid wall having an outwardly projecting ledge extending therearound adjacent to the top thereof to limit the depth of insertion of the lid into the open top of the carton, said lid wall also having at least one outwardly projecting rib extending therearound below the outwardly projecting ledge, said at least one rib projecting outwardly a distance substantially less than the ledge so as to frictionally engage the inner wall of the open top of the carton to retain the lid in assembly therewith, and a portion of each rib being recessed to accommodate a double thickness portion of the wall of the carton.

2. A carton lid according to claim 1 wherein the lip extends for substantially the whole length of a side or end of the lid.

3. A carton lid according to claim 1 comprising two of said lips at opposite sides or ends of the lid.

4. A carton lid according to claim 1 comprising four of said lips at opposite sides and ends of the lid, each lip extending for substantially the whole length of the side or end concerned and being at least partially spaced from adjacent lips at the corners of the lid.

5. A carton lid according to claim 1 wherein the externally recessed portion of each rib is adjacent a corner of the lid.

6. A closed carton assembly comprising a carton and a removable and replaceable lid, said lid being formed as a single molding of synthetic plastic material and the carton being formed from a one-piece cardboard blank to provide a rectangular body with a closed bottom and an open top into which the lid is inserted, the lid having an imperforate rectangular base, a peripherally continuous wall extending upwardly from the periphery of the base, and at least one lip projecting inwardly from the wall adjacent to the top thereof and spaced above the base to enable fingers of a human hand to be inserted under the lip to enable the lid to be removed from the carton, said lid wall having an outwardly projecting ledge extending therearound adjacent to the top thereof and limiting the depth of insertion of the lid into the open top of the carton, said lid wall also having at least one outwardly projecting rib extending therearound below the outwardly projecting ledge, said at least one rib projecting outwardly a distance substantially less than the ledge and frictionally engaging the inner wall of the open top of the carton to retain the lid in assembly therewith, said rectangular carton body being formed by securing opposed side edge portions of the blank together in overlapping relationship, with the carton body wall consequently having a wall portion of double thickness where the overlap occurs, and a portion of each rib being recessed to accommodate said double thickness portion of the carton wall.

7. A carton assembly according to claim 6 wherein the lip of the lid extends for substantially the whole length of a side or end of the lid.

8. A carton assembly according to claim 6 wherein the lid comprises two of said lips at opposite sides or ends of the lid.

9. A carton assembly according to claim 6 wherein the lid comprises four of said lips at opposite sides and ends of the lid, each lip extending for substantially the whole length of the side or end concerned and being at least partially spaced from adjacent lips at the corners of the lid.

10. A carton assembly according to claim 6, wherein the double thickness portion of the carton wall is adjacent a corner of the carton body and the externally recessed portion of each rib is likewise adjacent a corner of the lid.

* * * * *